US009194389B2

(12) United States Patent
Yu

(10) Patent No.: US 9,194,389 B2
(45) Date of Patent: Nov. 24, 2015

(54) HIGHLY AIRTIGHT GAS PUMP

(71) Applicant: TRICORE CORPORATION, Chang Hua County (TW)

(72) Inventor: Cheng-Fang Yu, Chang Hua County (TW)

(73) Assignee: Tricore Corporation, Hwa Tang Township, Chang Hua County (TW)

( * ) Notice: Subject to any disclaimer, the term of this patent is extended or adjusted under 35 U.S.C. 154(b) by 362 days.

(21) Appl. No.: 13/648,875

(22) Filed: Oct. 10, 2012

(65) Prior Publication Data

US 2014/0099222 A1 Apr. 10, 2014

(51) Int. Cl.

| | |
|---|---|
| ***F04B 43/02*** | (2006.01) |
| ***F04B 43/04*** | (2006.01) |
| ***F04B 45/02*** | (2006.01) |
| ***F04B 45/027*** | (2006.01) |
| ***F04B 45/047*** | (2006.01) |
| ***F04B 45/04*** | (2006.01) |
| *F04B 1/20* | (2006.01) |
| *F04B 39/10* | (2006.01) |

(52) U.S. Cl.

CPC ..... *F04B 43/026* (2013.01); *F04B 43/025* (2013.01); *F04B 43/04* (2013.01); *F04B 45/022* (2013.01); *F04B 45/027* (2013.01); *F04B 45/04* (2013.01); *F04B 45/043* (2013.01); *F04B 45/047* (2013.01); *F04B 1/205* (2013.01); *F04B 39/1033* (2013.01)

(58) Field of Classification Search

CPC ..... F04B 43/04; F04B 43/025; F04B 45/022; F04B 45/027; F04B 45/043; F04B 45/047; F04B 45/026; F04B 43/026; F04B 45/04

USPC ..... 417/269, 271, 413.1, 539, 479, 531, 417/533, 566; 92/57, 71; 91/503; 137/512, 137/512.4, 512.3

See application file for complete search history.

(56) References Cited

U.S. PATENT DOCUMENTS

| | | | | | |
|---|---|---|---|---|---|
| 3,058,140 | A * | 10/1962 | Henss | B60S 1/48 | 15/250.01 |
| 3,819,306 | A * | 6/1974 | Russell | 417/566 | |
| 4,801,249 | A * | 1/1989 | Kakizawa | 417/269 | |
| 5,192,200 | A * | 3/1993 | Lilie | F04B 39/1073 | 137/855 |
| 6,264,438 | B1 * | 7/2001 | Fukami | F04B 1/148 | 417/412 |
| 6,555,062 | B1 * | 4/2003 | Lewis | B01L 3/508 | 215/DIG. 1 |
| 6,716,005 | B2 * | 4/2004 | Yamakawa | F04B 43/026 | 417/521 |
| 2003/0086803 | A1 * | 5/2003 | Fukami | F04B 43/026 | 417/566 |
| 2006/0025693 | A1 * | 2/2006 | Sano | A61B 5/02141 | 600/490 |
| 2007/0160485 | A1 * | 7/2007 | Huang | 417/473 | |
| 2014/0000853 | A1 * | 1/2014 | Moreau | B21C 37/225 | 165/168 |

* cited by examiner

*Primary Examiner* — Devon Kramer
*Assistant Examiner* — Jon Hoffmann
(74) *Attorney, Agent, or Firm* — Muncy, Geissler, Olds & Lowe, P.C.

(57) ABSTRACT

A gas pump is composed of a gas suction member and a gas exhaust member. The gas suction member includes a gasbag having a hollow retractable portion being drivable by a motor for oppression or expansion, an intake valve allowing the air to pass therethrough when the hollow retractable portion is oppressed, and a flexible tube having two crosscuts, by which the flexible tube is divided into two vent valvular pieces. Each of the vent valvular pieces has a reinforcing strip formed on an internal wall thereof for forcing each of the vent valvular pieces to seal the exhaust passage. The gas exhaust member is mounted to the gasbag and includes a venthole and a guide slot. The venthole can receive the flexible tube therein. The guide slot communicates the hollow retractable portion and the intake valve for guiding the air into the hollow retractable portion.

5 Claims, 6 Drawing Sheets

HIGHLY AIRTIGHT GAS PUMP

BACKGROUND OF THE INVENTION

1. Field of the Invention

The present invention relates generally to a gas pump and more particularly, to a highly airtight gas pump.

2. Description of the Related Art

A conventional gas pump is composed of an outtake valve, a stopper, a gasbag assembly, a plurality of intake plug, and a control bar, controlling ascent or descent of the control bar via a motor for oppressing and inflating each gasbag of the gasbag assembly. When each gasbag is oppressed, the air is sucked into the gasbag through each inlet. When each gasbag is inflated, the air is expelled out of the gasbag through a valvular piece. In this way, the purposes of air charging and discharging can be reached.

However, in the aforesaid structure, the number of the components of the conventional gas pump are numerous and they are manufactured individually and then put together, so the assembly of those parts becomes a trouble and the parts are subject to malposition therebetween in the process of the assembly to bring adverse effect to the overall airtightness. In this way, overgreat noise may happen while the air is being charged into and discharged from the gasbags. Thus, the conventional gas pump needs further improvement.

SUMMARY OF THE INVENTION

The primary objective of the present invention is to provide a gas pump which is highly airtight, structurally simple, and convenient in assembly.

The foregoing objective of the present invention is attained by the gas pump composed of a gas suction member and a gas exhaust member. The gas suction member includes a gasbag holder and a gasbag. The gasbag holder has a receiving a hole and a pore. The gasbag is mounted to the gasbag holder and has a plate, a hollow retractable portion, an intake valve, and a flexible tube. The plate is fixed to the gasbag holder. The hollow retractable portion extends outwardly from one of two sides of the plate and is received in the receiving hole of the gasbag holder for being driven by a motor to move between an oppression position and an expansion position. The intake valve is mounted to the plate and movably covered on the pore for allowing the air to pass therethrough when the hollow retractable portion is located at the oppression position. The flexible tube is extends outwardly from the other side of the plate and includes two crosscuts, by which the flexible tube is divided into two vent valvular pieces by the two crosscuts. Each of the vent valvular pieces has a reinforcing strip formed at an internal wall thereof for forcing each of the vent valvular pieces to prevent the air from pass therethrough when the hollow retractable portion is located at the expansion position. The gas exhaust member is covered on the gasbag and includes a venthole and a guide slot. The venthole communicates with the hollow oppression portion for receiving the flexible tube therein. The guide slot is located between the hollow retractable portion and the intake valve for communication therebetween for guiding the air passing through the intake valve into the hollow retractable portion.

In light of the structure indicated above, the hollow retractable portion, the intake valve, and the flexible tube are integrated in one piece, so the whole number of the components is reduced to simplify the assembly process. Besides, the reinforcing strips ensure high airtightness for the whole structure of the present invention.

DETAILED DESCRIPTION OF PREFERRED EMBODIMENTS

A preferred embedment of the present invention is provided in the following paragraphs accompanied with the drawings to describe and illustrate the structure, technical features, and effects of the present invention recited as follows.

Figure 1:
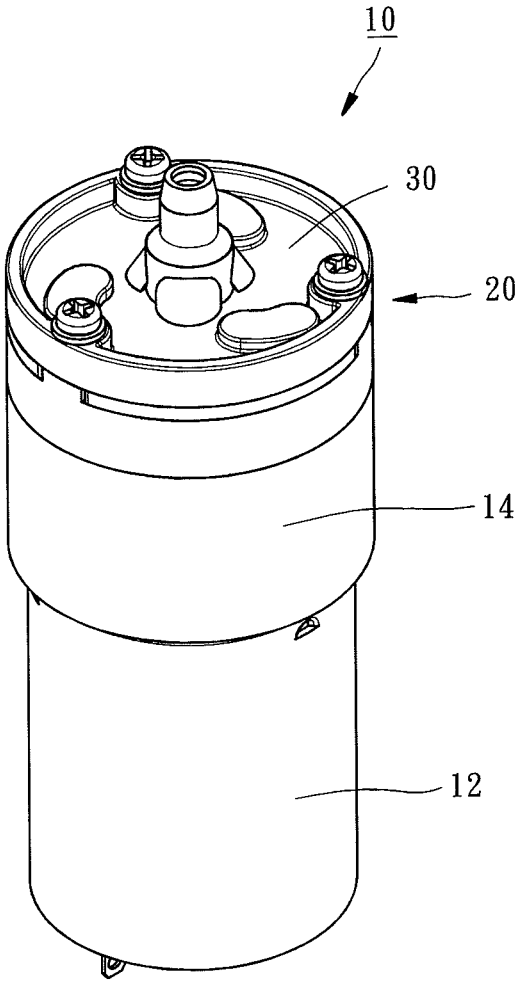
FIG. 1 is a perspective view of a preferred embodiment of the present invention.
Figure 2:
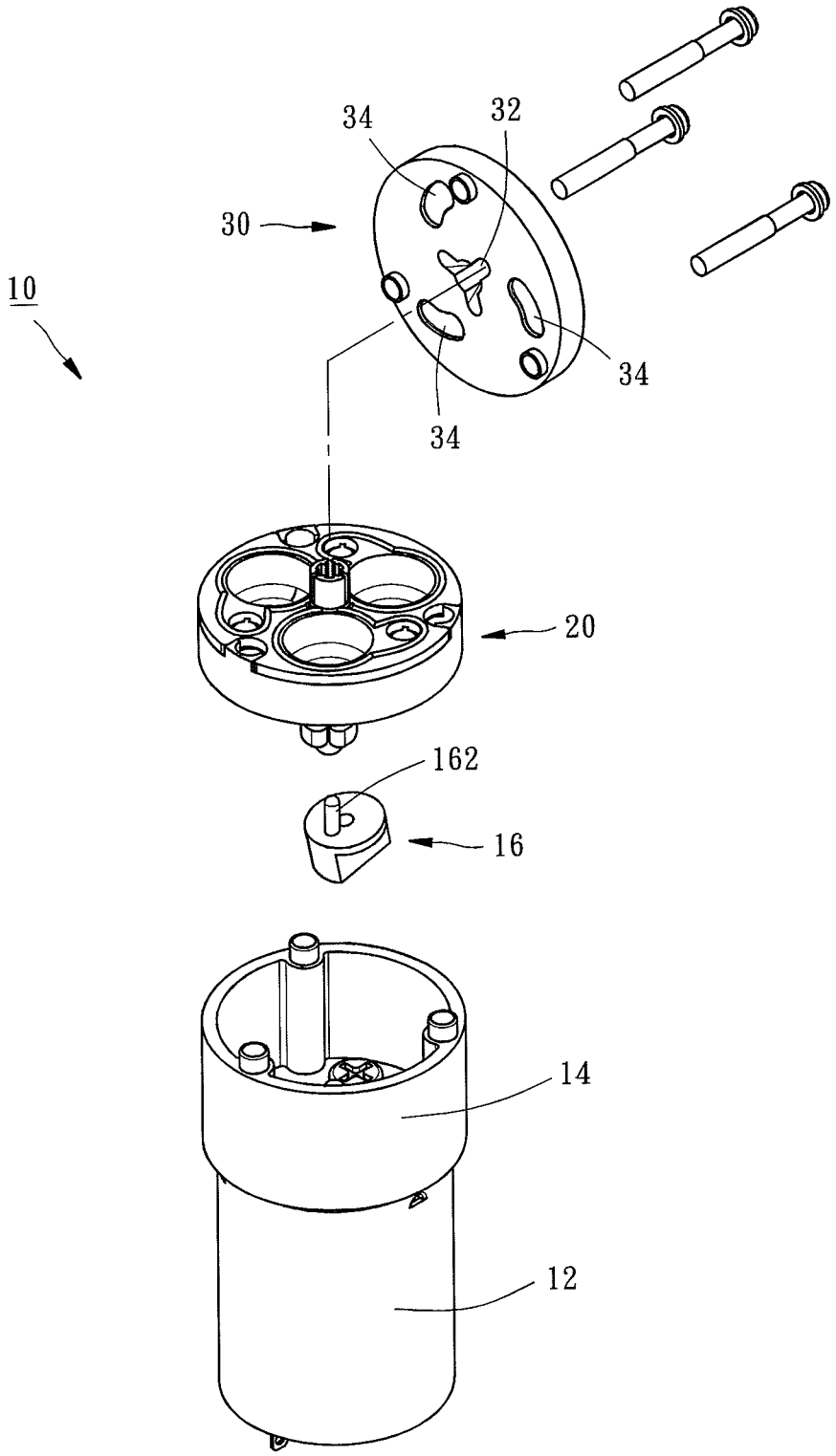
FIG. 2 is an exploded view of the preferred embodiment of the present invention.
Figure 6B:
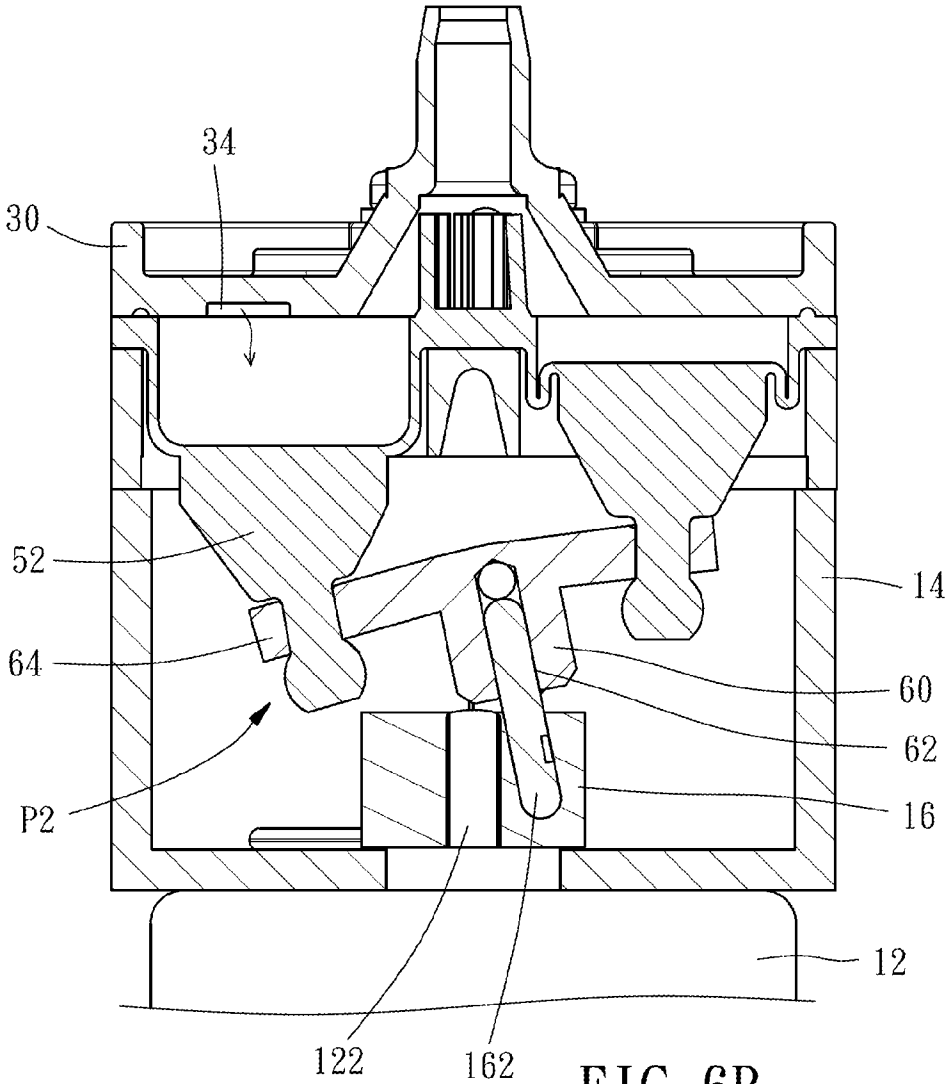
FIGS. 6B and 6C each are a sectional view of he preferred embodiment of the present invention, illustrating the status of the airflow.

Referring to FIGS. 1-2, a gas pump 10 constructed according to a preferred embodiment of the present invention can be driven by a motor 12 for gas charging and discharging. The motor 12 is fixed to a motor holder 14 and includes a rotary shaft 12, as shown in FIG. 6B. The rotary shaft 122 is sleeved with a swivel member 16 having an eccentric shaft 162 arranged slantingly. The gas pump 10 of the present invention is composed of a gas suction member 20 and a gas exhaust member 30. The detailed descriptions and operations of these elements as well as their interrelation are recited in the respective paragraphs as follows.

Figure 3:
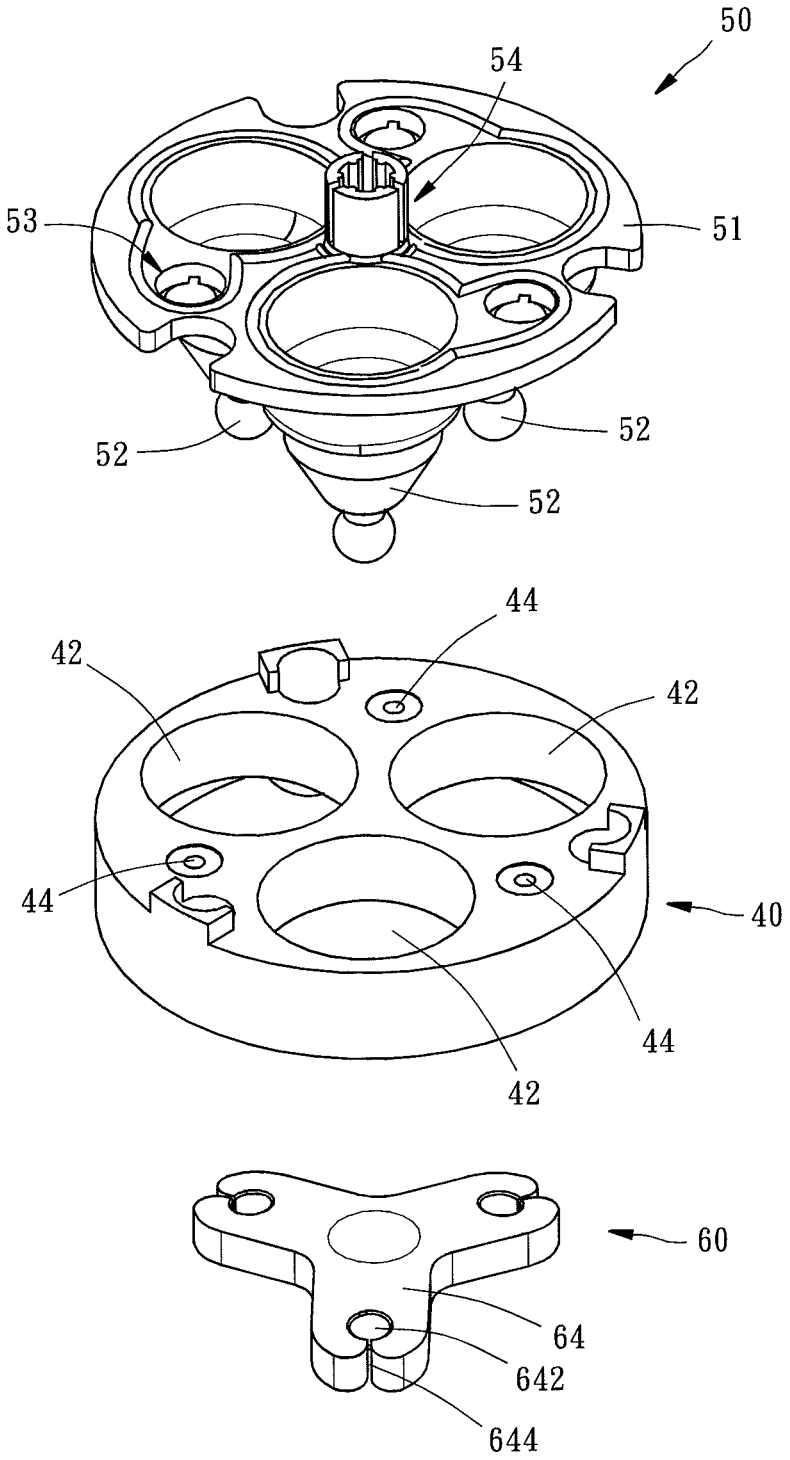
FIG. 3 is an exploded view of the gas suction member of the preferred embodiment of the present invention.
Figure 4:
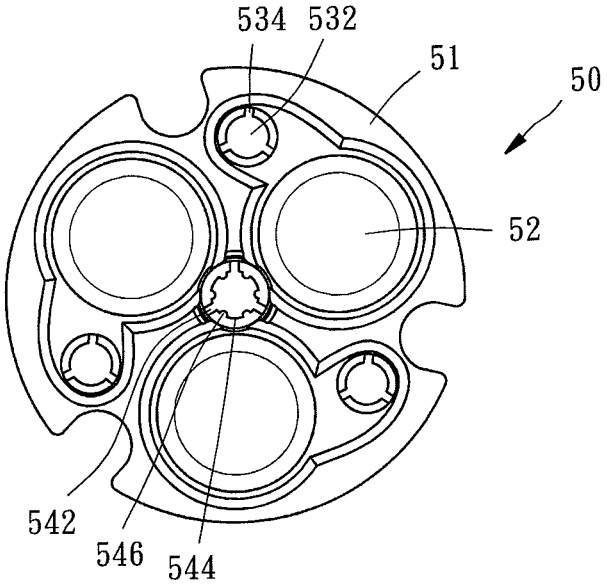
FIG. 4 is a top view of the gasbag of the preferred embodiment of the present invention.
Figure 5:
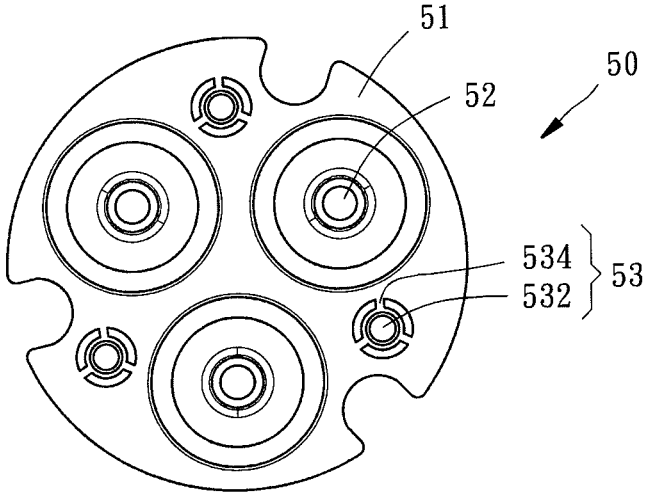
FIG. 5 is a bottom view of the gasbag of the preferred embodiment of the present invention.

Referring to FIGS. 3-5, the gas suction member 20 is formed of a gasbag holder 40, a gasbag 50, and a pressure control bar 60. The gasbag holder 40 includes three receiving holes 42 and three pores 44, all of which are arranged alternately. The gasbag 50 has a plate 51, three hollow retractable portions 52, three intake valves 53, and a flexible tube 54. The plate 51 is fixed to a top side of the gasbag holder 40. Each of the hollow retractable portions 52 extends outwardly from a bottom side of the plate 51 and is received in one of the receiving holes 42. Each of the intake valves 53 includes a valvular member 532 and three connection strips 534. Each of the valvular members 532 covers one of the pores 44. Each of the connection strips 534 is connected between the plate 51 and the valvular member 532. The flexible member 54 extends outwardly from a top side of the plate 51 and includes three crosscuts 542 in such a way that the flexible member 54 is divided into three vent valvular pieces 544 by the three crosscuts 542. Each of the vent valvular pieces 544 includes two reinforcing strips 546 formed on an internal wall thereof. The pressure control bar 60 includes an insertion hole 62 formed at a center of a bottom side thereof for insertion of the eccentric shaft 162 therein. Besides, the pressure control bar 60 includes three grappling portions 64, each of which has a retaining hole 642 and an access gap 644 in communication with the retaining hole 642. In assembly, respective bottom ends of the hollow retractable portions 52 can pass through the access gaps 644 to be held inside the retaining hole 642.

The gas exhaust member 30 is fixed onto the top side of the plate 51 and includes a venthole 32 and three guide slots 34.

The venthole 32 communicates with each of the hollow retractable portions 52 for receiving the flexible tube 54 therein. Each of the guide slots 34 communicates with the adjacent hollow retractable portion 52 and the adjacent intake valve 53 for guiding the air passing through the intake valves 53 into the hollow retractable portions 52.

Figure 6A:
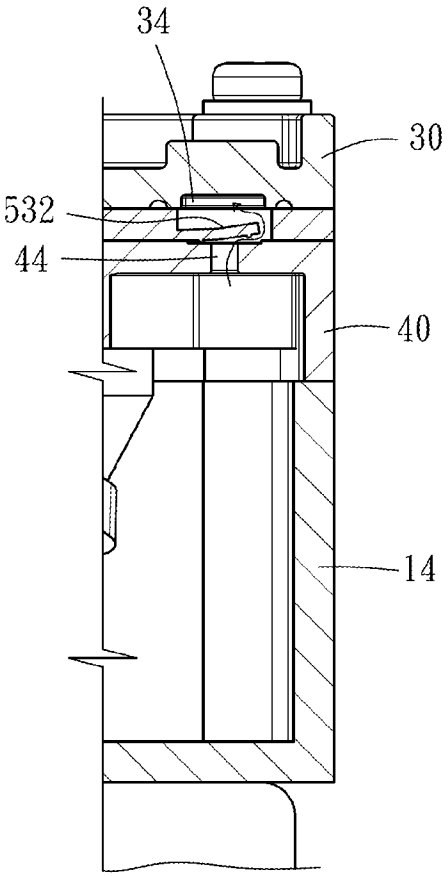
FIG. 6A is a sectional view of a part of the preferred embodiment of the present invention, illustrating that the air passes through the intake valve.
Figure 6C:
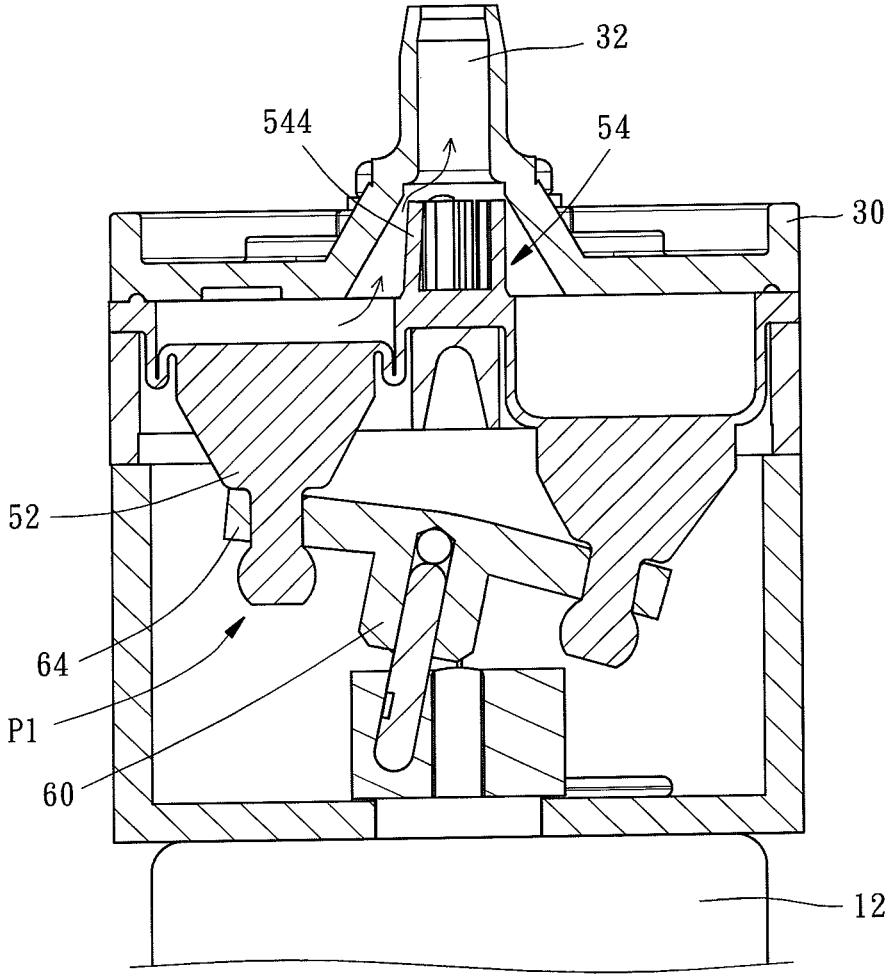

When it is intended to operate the gas pump 10, the operational process of each hollow retractable portion 52 of the gasbag 50 is identical of the other hollow retractable portions 52, so only one hollow retractable portion 52 is illustrated for its operational process as an example to prevent the whole specification from redundancy. First, the motor 12 can drive rotation of the swivel member 16. Next, the swivel member 16 can force the grappling portion 64 via the eccentric shaft 162 to rise or drop for linking-up with the hollow retractable portion 52 in such a way that the hollow retractable portion 52 is movable between an oppression position P1 and an expansion position P2. When the hollow retractable portion 52 is located at the expansion position P2, the air inside the motor holder 14 can be sucked to pass through the pore 44 and then push the valvular members 532 to enter the guide slot 34, as shown in FIG. 6A, and finally enter the hollow retractable portion 52 from the guide slot 34, as shown in FIG. 6B, in such a way that the hollow retractable portion 52 starts with air charging. When the motor 12 keeps working, the hollow retractable portion 52 is oppressed by the grappling portion 64 to move to the oppression position P1, as shown in FIG. 6C. In the meantime, the air inside the hollow retractable portion 52 is oppressed to push the vent valvular piece 544 to exhaust through the venthole 32. Once the air exhaust is completed, the vent valvular pieces 544 can be forced by the reinforcing strips 546 to return to the original position to prevent the air from passing therethrough. In this way, the motor 12 keeps working to drive the hollow retractable portion 52 to keep on air charging and discharging.

In conclusion, the gas pump 10 of the present invention integrates the hollow retractable portions 52, the intake valves 53, and the flexible tube 54 as a whole, so the whole number of the components of the gas pump is reduced to simplify the assembly process. Besides, the connection strips 534 and the reinforcing strips 546 enable the intake valves 53 and the vent valvular pieces 544 to secure high airtightness.

Although the present invention has been described with respect to a specific preferred embodiment thereof, it is in no way limited to the specifics of the illustrated structures but changes and modifications may be made within the scope of the appended claims.

What is claimed is:

1. A highly airtight gas pump, which can be driven by a motor for gas charging and discharging, the gas pump comprising:

a gas suction member having a gasbag holder and a gasbag, the gasbag holder having a receiving hole and a pore, the gasbag having a plate, a hollow retractable portion, an intake valve, and a flexible tube, the plate being fixed to the gasbag holder, the hollow retractable portion extending outwardly from one of two sides of the plate and received in the receiving hole of the airbag holder for being driven by the motor to move between an oppression position and an expansion position, the intake valve being mounted to the plate and movably covering the pore of the gasbag holder, the flexible tube extending outwardly from the other side of the plate and having at least two crosscuts, the flexible tube being divided into at least two vent valvular pieces by the two crosscuts, each of the vent valvular pieces having a reinforcing strip formed on an internal wall thereof and being movable inwardly by the air inside the hollow retractable portion; and a gas exhaust member covered on the gasbag of the gas suction member and having a venthole and a guide slot, the venthole communicating with the hollow retractable portion for receiving the flexible tube therein, the guide slot communicating with the hollow retractable portion and the intake valve, the guide slot being used for guiding the air inside the intake valve into the hollow retractable portion.

2. The highly airtight gas pump as defined in claim 1, wherein the gas suction member further comprises a pressure control bar, wherein the pressure control bar is connected with the hollow retractable portion of the gasbag and can be driven by the motor to force the hollow retractable portion of the gasbag to move between the oppression position and the expansion position.

3. The highly airtight gas pump as defined in claim 2, wherein the pressure control bar comprises a grappling portion, the grappling portion having a retaining hole and an access gap in communication with the retaining hole; a bottom end of the hollow retractable portion of the gasbag passes through the access gap to be held inside the retaining hole.

4. The highly airtight gas pump as defined in claim 1, wherein the intake valve of the gasbag comprises a valvular member and at least two connection strips, the valvular member covering the pore of the gasbag holder, each of the connection strips being connected between the plate and the valvular member.

5. The highly airtight gas pump as defined in claim 4, wherein the intake valve of the gasbag comprises three said connection strips circularly arranged around the intake valve.

* * * * *